US005969683A

United States Patent [19]

Hayes et al.

[11] Patent Number: 5,969,683

[45] Date of Patent: Oct. 19, 1999

[54] RADIOTELEPHONES WITH ANTENNA MATCHING SWITCHING SYSTEM CONFIGURATIONS

[75] Inventors: Gerard J. Hayes, Wake Forest; Howard E. Holshouser, Efland, both of N.C.

[73] Assignee: Ericsson Inc., Research Triangle Park, N.C.

[21] Appl. No.: 08/858,982

[22] Filed: May 20, 1997

[51] Int. Cl.[6] ..... H01Q 1/24

[52] U.S. Cl. ..... 343/702; 343/901; 343/852

[58] Field of Search ..... 343/702, 850, 343/900, 745, 852, 860, 861, 901

[56] References Cited

U.S. PATENT DOCUMENTS

| | | | |
|---|---|---|---|
| 4,860,024 | 8/1989 | Egashira | 343/702 |
| 5,030,966 | 7/1991 | Chin et al. | 343/702 |
| 5,374,937 | 12/1994 | Tsunekawa et al. . | |
| 5,583,519 | 12/1996 | Koike . | |
| 5,670,968 | 9/1997 | Inanaga et al. | 343/901 |
| 5,801,662 | 9/1998 | Itoh | 343/702 |
| 5,831,579 | 11/1998 | Rudisill | 343/702 |

FOREIGN PATENT DOCUMENTS

| | | |
|---|---|---|
| 0 508 836 A1 | 10/1992 | European Pat. Off. . |
| 0 613 206 A1 | 8/1994 | European Pat. Off. . |
| 0 718 909 A2 | 6/1996 | European Pat. Off. . |
| 196 39 642 A1 | 4/1997 | Germany . |
| 7-235819 | 9/1995 | Japan . |
| 2 308 746 | 7/1997 | United Kingdom . |

OTHER PUBLICATIONS

PCT International Search Report, Int'l App. No. PCT/US98/10262.

*Primary Examiner*—Don Wong
*Assistant Examiner*—Jennifer H. Malos
*Attorney, Agent, or Firm*—Myers Bigel Sibley & Sajovec, P.A.

[57] ABSTRACT

A radiotelephone matching switching system and associated antenna and printed circuit board contact configurations for a retractable antenna employs at least two contacts which are traversely spaced apart in the radiotelephone housing so as to reduce the space used therein. One embodiment also allows reactive components of the circuit to be disconnected thereby increasing the operational bandwidth of the radiotelephone.

30 Claims, 7 Drawing Sheets

RETRACTED

RETRACTED

EXTENDED

EXTENDED

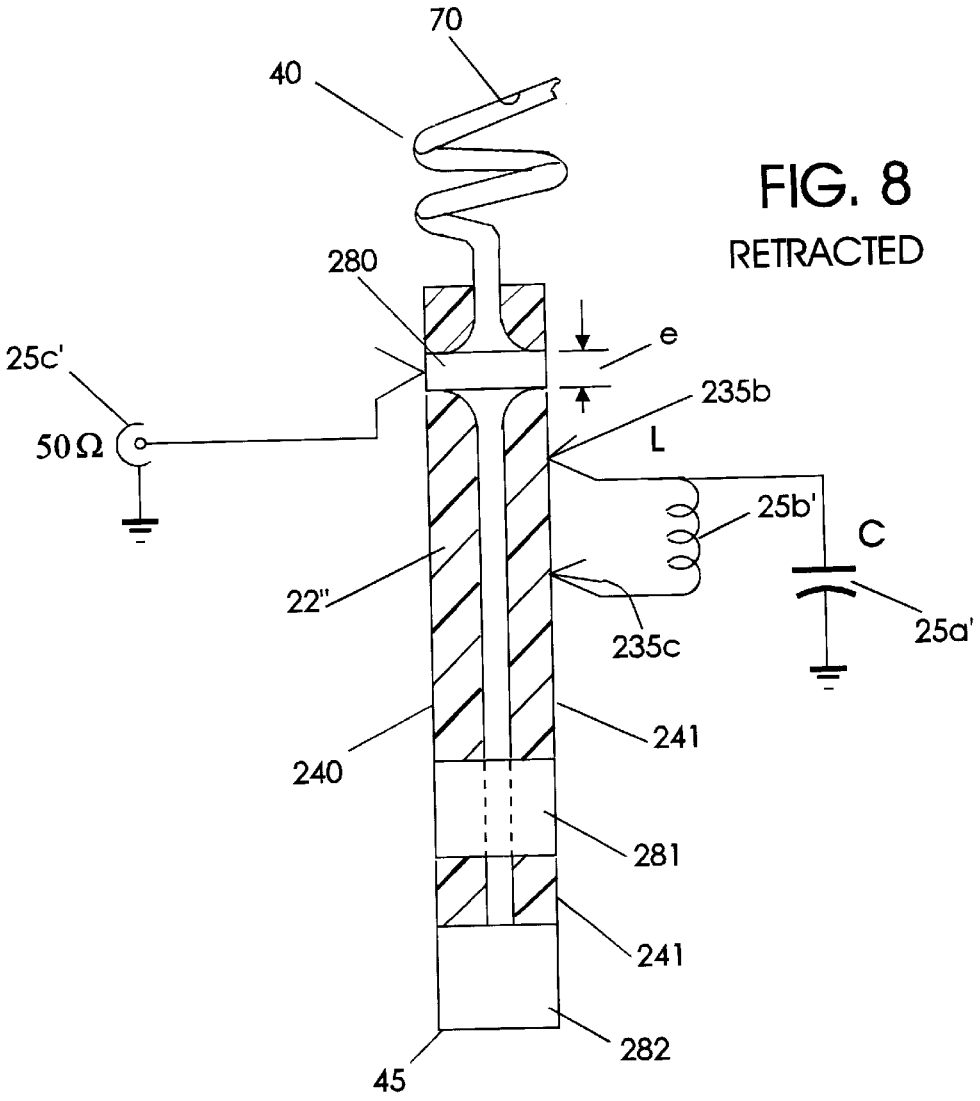
FIG. 8
RETRACTED
FIG. 9
RETRACTED
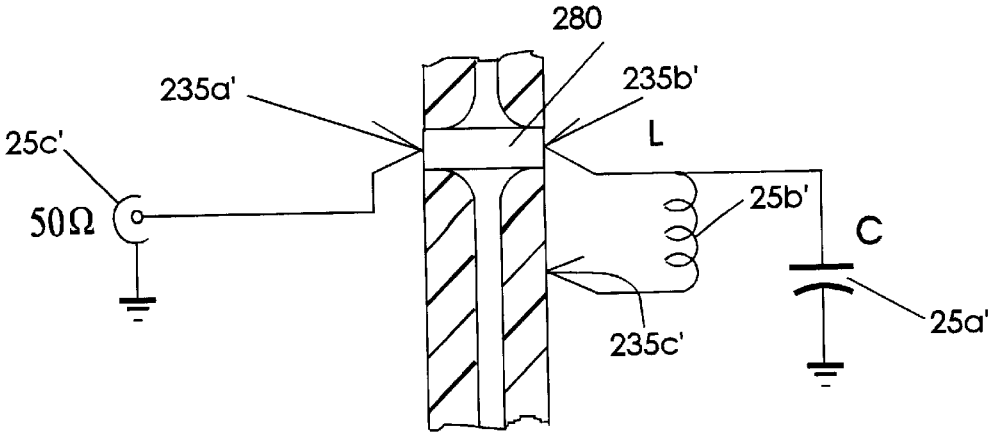

EXTENDED

EXTENDED

RETRACTED

RETRACTED

RETRACTED

EXTENDED

RETRACTED

EXTENDED

RADIOTELEPHONES WITH ANTENNA MATCHING SWITCHING SYSTEM CONFIGURATIONS

FIELD OF THE INVENTION

The present invention relates to radiotelephones, and more particularly relates to retractable antennas for radiotelephones.

BACKGROUND OF THE INVENTION

Many radiotelephones employ retractable antennas, i.e., antennas which are extendable and retractable out of the radiotelephone housing. The retractable antennas are electrically connected to a signal processing circuit positioned on an internally disposed printed circuit board. In order to optimally operate, the signal processing circuit and the antenna should be interconnected such that the respective impedances are substantially "matched", i.e., electrically tuned to filter out or compensate for undesired antenna impedance components to provide a 50 Ohm impedance value at the circuit interconnection. Unfortunately, complicating such a matching system, a retractable antenna by its very nature has dynamic components, i.e., components which move or translate with respect to the housing and the printed circuit board and as such generally does not have a single impedance value. Instead, the retractable antenna typically generates largely different impedance values when in an extended versus a retracted position. Therefore, it is preferred that the impedance matching system alter or "switch" the antenna's impedance to properly match the terminal's impedance both when the antenna is retracted and extended.

The physical configuration of the matching network is further complicated by the miniaturization of the radiotelephone and the internally disposed printed circuit board. Many of the more popular hand-held telephones are undergoing miniaturization. Indeed, many of the contemporary models are only 11–12 centimeters in length. Because the printed circuit board is disposed inside the radiotelephone, its size is also shrinking, corresponding to the miniaturization of the portable radiotelephone. Unfortunately, as the printed circuit board decreases in size, the amount of space which is available to support desired operational and performance parameters of the radiotelephone generally is correspondingly reduced. Therefore, it is desirable to efficiently and effectively utilize the limited space on the printed circuit board.

This miniaturization can also create complex mechanical and electrical connections with other components such as the outwardly extending antenna which must generally interconnect with the housing for mechanical support, and, as discussed above, to an impedance matching system operably associated with the printed circuit board in order for the signal to be properly processed.

Referring to FIGS. 1A and 1B, desired equivalent circuits 10, 10' are illustrated for extended and retracted antenna positions, respectively. As shown in FIG. 1A, in the extended position the antenna rod 12 operates with a half-wave ($\lambda/2$) load. In this situation, the associated impedance may rise as high as 600 Ohms. In contrast, in the retracted position, as shown in FIG. 1B, the antenna rod 12 operates with a quarter-wave ($\lambda/4$) load with an impedance typically near 50 Ohms. Therefore, it will be appreciated that when the antenna is in the extended position an L-C matching circuit 15 may be needed to counteract the impedance introduced thereby.

In the past, conventional portable radiotelephones have used a variety of antenna connections to match the impedance in the antenna to the housing and the printed circuit board. For example, U.S. Pat. No. 5,374,937 to Tsunekawa et al. describes top load antennas and matching circuits, the content of which is hereby incorporated herein in its entirety as if recited in full herein. Tsunekawa et al. proposes longitudinally aligned but downwardly spaced-apart terminals or contacts on the printed circuit board and corresponding concave contact chips on the antenna in the radiotelephone housing. The terminals and mating chips act to engage with or short out of the associated matching network. Unfortunately and disadvantageously, this type of switching connection may use an undesirable amount of space on the printed circuit board. In addition, this configuration can limit the operational bandwidth of the radiotelephone.

OBJECTS AND SUMMARY OF THE INVENTION

It is a first object of the present invention to provide a matching switching system configuration which reduces the amount of printed circuit board space necessary to operate the switching system.

It is a further object of the present invention to increase the operational bandwidth of the radiotelephone.

It is yet another object of the present invention to provide a low-cost, easy to manufacture antenna to printed circuit board contact configuration for a radiotelephone antenna matching switching system.

These and other objects are satisfied by the present invention, which provides as a first aspect of the invention a radiotelephone with transversely spaced-apart contacts. The radiotelephone comprises a retractable antenna having opposing first and second ends and defining a central axis through the center thereof. The antenna is slidably extendable about the central axis between a first extended position and a second retracted position. The antenna has a first impedance in the first position and a second impedance less than the first impedance in the second position. The radiotelephone also includes a radiotelephone housing configured to receive the retractable antenna therein. The radiotelephone also includes a radiotelephone printed circuit board disposed in the housing adjacent the antenna. The printed circuit board includes first and second transversely spaced-apart antenna circuit contacts, each positioned on different sides of the central axis. The radiotelephone also includes a matching circuit operably associated with each of the antenna circuit contacts. In operation, when the antenna is extended the matching circuit is activated to match the increased impedance attributed thereto.

Preferably, the radiotelephone matching circuit is activated by contact with a selected one of the first and second transversely spaced-apart antenna circuit contacts. Also preferably, the first and second transversely spaced-apart antenna circuit contacts are positioned on the printed circuit board such that each is substantially co-planar with the other along the plane of contact with the antenna. Advantageously, this configuration reduces and preferably minimizes the amount of board and radiotelephone space needed to switch the matching network.

In an additional embodiment of the present invention, a radiotelephone, similar to the one described above, has a retractable antenna with an offset conducting circuit contact portion on the second end offset from the central axis. In the extended position, the matching circuit is electrically activated by contact with the antenna offset portion to match the increased impedance attributed thereto. Preferably, when the antenna is in an extended position, one of the first and second contacts engages with the antenna circuit offset portion to electrically connect said matching circuit. Further preferably, the antenna is configured to resist rotation about the central axis thereby providing easy alignment and activation of the offset contact to the matching circuit.

In yet another aspect of the present invention, a radiotelephone printed circuit board includes first, second, and third antenna circuit contacts. Similar to the embodiments described above, the first and second contacts are transversely spaced-apart such that each is positioned on different sides of the central axis. However, the third contact is electrically connected with and positioned longitudinally spaced-apart from one of the first and second contacts. The matching circuit is operably associated with each of the antenna circuit contacts such that when the antenna is extended the matching circuit is activated to match the increased impedance attributed thereto.

Preferably, the radiotelephone is configured so that when the antenna is in the retracted position the antenna disconnects reactive components of the matching circuit thereby enabling a broader radiotelephone operational bandwidth. Further preferably, the antenna includes a plurality of electrically connected but longitudinally spaced-apart conducting portions along the length thereof for engaging with selected ones of the first, second, and third contacts. Accordingly, it is also preferred that the antenna outer surface is formed of a non-conducting substrate material intermediate of the conducting portions.

The foregoing and other objects and aspects of the present invention are explained in detail in the specification set forth below.

BRIEF DESCRIPTION OF THE DRAWINGS

FIG. 8 is a schematic representation of the embodiment shown in FIG. 7 illustrating the antenna in a retracted position.

FIG. 9 is a schematic representation of an alternative contact configuration of the embodiment illustrated in FIGS. 8 and 9.

DETAILED DESCRIPTION OF PREFERRED EMBODIMENTS

Figure 1A:
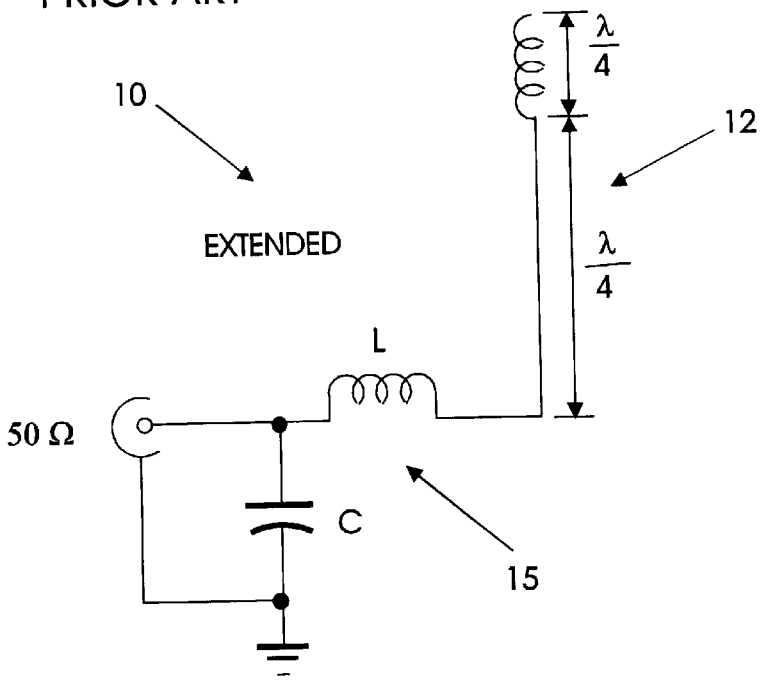
FIG. 1A PRIOR ART
FIG. 1A is a schematic representation of the equivalent circuit of a conventional extended half-wave antenna and an associated L-C matching circuit.
Figure 1B:
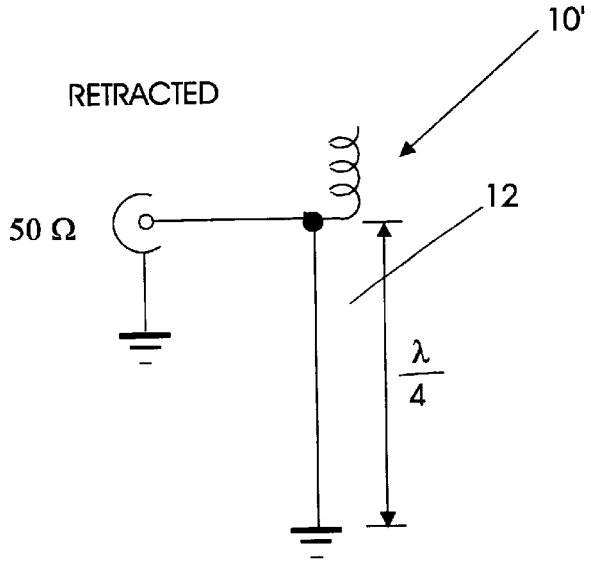
FIG. 1B PRIOR ART
FIG. 1B is a schematic representation of the equivalent circuit of the antenna of FIG. 1A, but in a retracted position, shown as a quarter-wave stub.

The present invention will now be described more fully hereinafter with reference to the accompanying figures, in which preferred embodiments of the invention are shown. This invention may, however, be embodied in many different forms and should not be construed as limited to the embodiments set forth herein. Like numbers refer to like elements throughout.

Generally described, as illustrated in FIGS. 11A–11D, the present invention is directed towards radiotelephones 20 with retractable antennas 22 and matching circuits 25. The radiotelephones 20 include a switching system 28 which provides spatially efficient and mechanical switching of the matching circuit(s) 25 corresponding to predetermined positions of the translating antenna 22, i.e., corresponding to the retracted or extended position of the antenna 22 relative to the radiotelephone housing 30. When the antenna 22 is extended, a major portion of the body is outside of the housing 30; in contrast, when the antenna 22 is retracted, a major portion of the antenna 22 is positioned inside the radiotelephone housing 30.

Figure 11A:
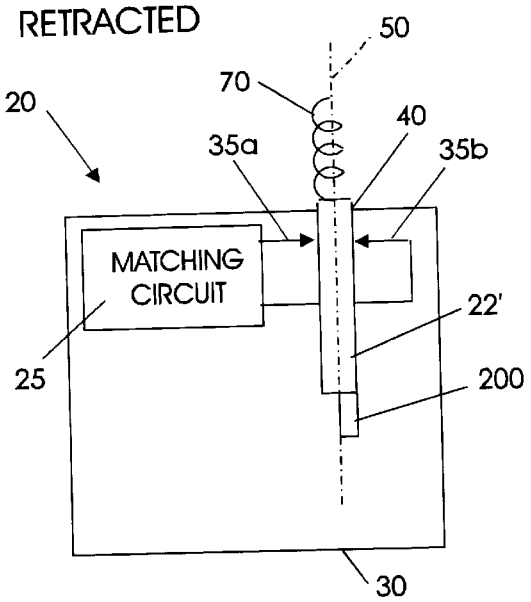
FIGS. 11A and 11B are schematic representations of a radiotelephone with the matching switching system illustrated in FIGS. 4 and 5.
Figure 11B:
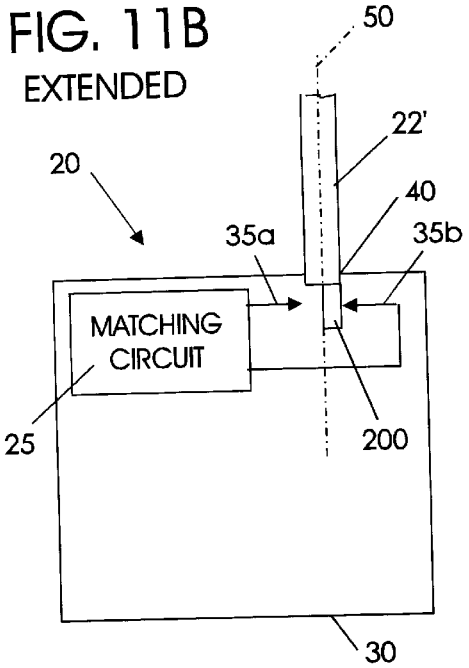

As schematically shown in FIGS. 11A and 11B, one embodiment of the switching system 28 includes a pair of transversely disposed antenna contacts 35*a*, 35*b* operably associated with the matching circuit 25. The contacts 35*a*, 35*b* and the antenna 22 are matably configured so that activation of the matching circuitry 25 occurs with the physical retraction and extension of the antenna 22. The antenna contacts 35*a*, 35*b* are preferably positioned on opposing sides of the central axis 50 adjacent the opening 40 in the radiotelephone housing 30 as will be discussed in more detail hereinbelow. As illustrated, this configuration advantageously reduces the amount of space utilized on the printed circuit board disposed to switch the matching circuit 25.

Figure 2:
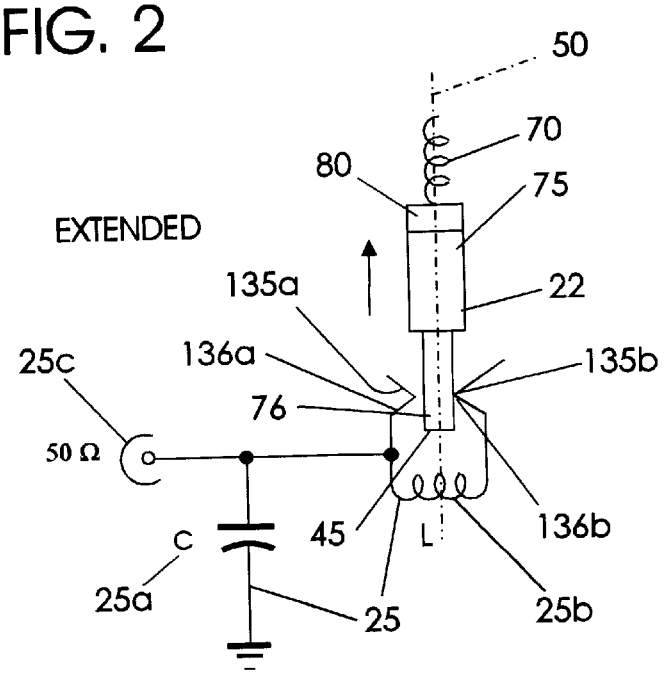
FIG. 2 is a schematic representation of one embodiment of a matching switching system, with the antenna in an extended position, according to the present invention.
Figure 2A:
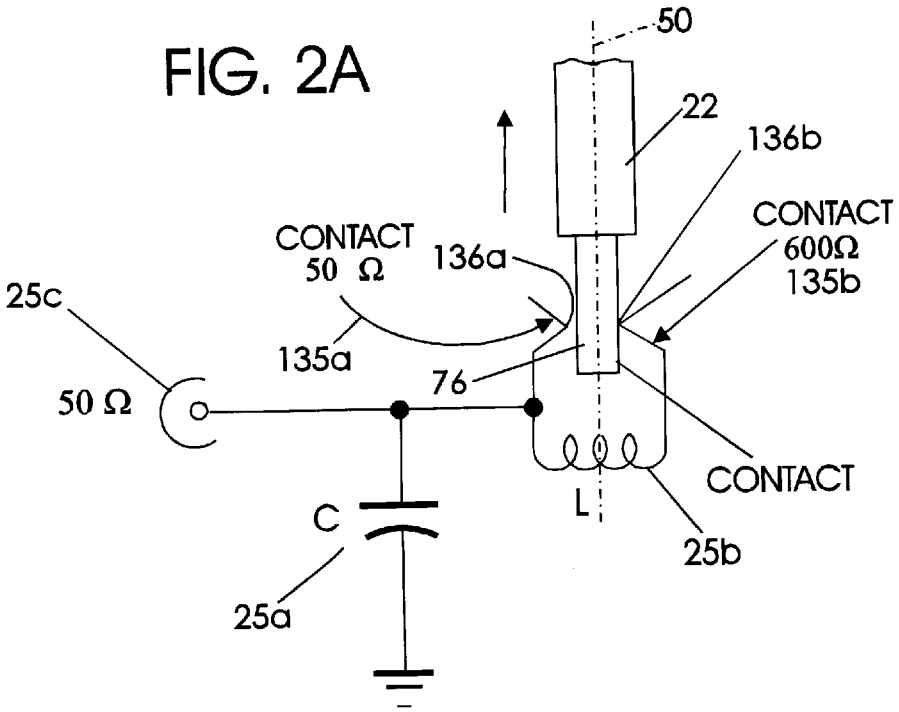
FIG. 2A is an enlarged view of the antenna and circuit contacts shown in FIG. 1.
Figure 3:
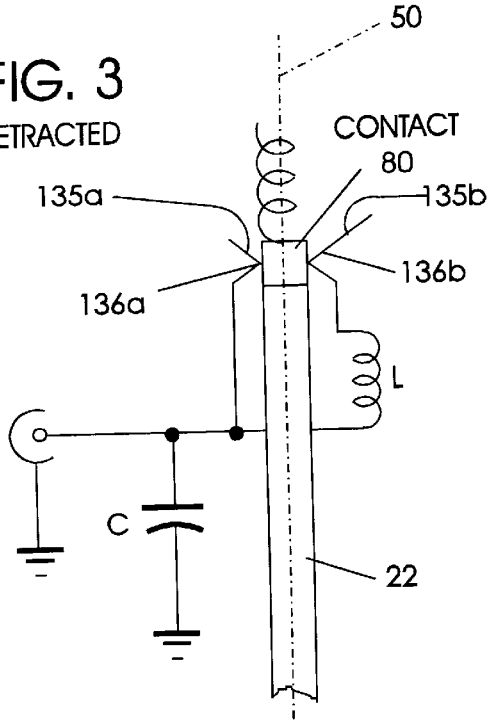
FIG. 3 is a schematic representation of the matching switching system illustrated in FIG. 2, but shows the antenna in the retracted position.

Turning now to FIGS. 2, 2A, and 3, a first embodiment of a switching system 28 is illustrated. FIGS. 2 and 2A show the antenna 22 in the extended position, and FIG. 3 shows the antenna 22 in the retracted position. The antenna 22 includes opposing first and second ends 40, 45 and defines a central axis 50 through the center thereof. As illustrated, the first end 40 extends out of the housing 30 and includes the top load antenna element 70. The antenna also includes a conducting contact portion 80 positioned below the antenna element 70. The conducting contact 80 is electrically connected to the antenna element 70. The second end 45 includes a second conducting portion 76 which remains within the housing 30 irrespective of the extension of the antenna 22. The second conducting portion 76 is also electrically connected to the antenna element 70 and is stepped to have a smaller cross-sectional area relative to the upper portion of the antenna body. Preferably, the second conducting portion 76 is concentrically aligned with the upper antenna body about the central axis 50.

In operation, the antenna 22 extends in and out of the housing opening 40 (FIGS. 4, 5, and 11) along the central axis 50. Preferably, the electrical length of the antenna 22 (defined by the top load element 70 and the length of the linear rod element 75) is predetermined. Further preferably, the electrical length of the antenna 22 is configured to provide a half wavelength or an integer multiple of a half wavelength so that the antenna 22 resonates with the operation frequency.

As illustrated in FIGS. 2 and 3, the switching system 28 includes first and second circuit contacts 135*a*, 135*b* which are operably associated with the antenna 22 and the printed circuit board 150 to engage or activate matching circuitry 25 or certain electrical components in the radiotelephone by selective electrical contact between the contacts 135*a*, 135*b* and the first and second conducting portions 80, 76 of the antenna 22. As shown, the left most contact 135*a* provides a 50 Ohm circuit contact which is activated when both contacts 135*a*, 135*b* are electrically engaged with the antenna first conducting portion 80, corresponding to a retracted antenna position. Similarly, the right most contact 135*b* provides a 600 Ohm circuit contact which is individually electrically engaged by contact with the second conducting portion of the antenna 76, corresponding to an extended antenna position.

As shown in FIG. 2A, to "switch" or activate the matching network or components thereof when extended, the antenna end portion 76 contacts a selected one of the contacts 135*b* to activate the associated matching components 25*a*, 25*b*. In contrast, when retracted, the antenna conducting contact portion 80 electrically connects with each of the contacts 135*a*, 135*b* by positioning the retracted antenna 22 therebetween, thereby short circuiting the matching components 25*a*, 25*b*. Thus, the interconnection of one or more of the contacts 135*a*, 135*b* with the first or second conducting portion 80, 76 of the antenna 22 provides different signal paths activating different matching circuit components.

Figure 10A:
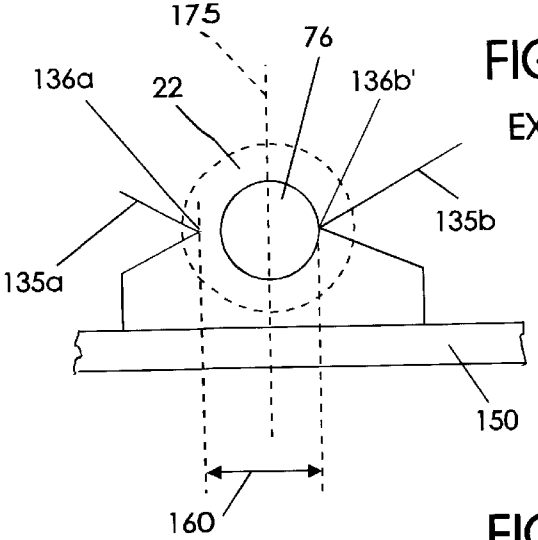
FIGS. 10A and 10C are schematic representations of end views of contact configurations of the matching switching system illustrated in FIGS. 2 and 3.
Figure 10B:
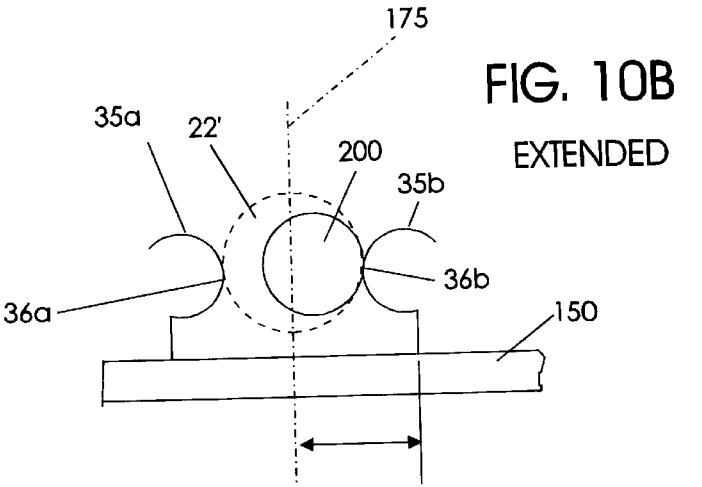
FIGS. 10B and 10D are schematic representations of end views of contact configurations of the matching switching system illustrated in FIGS. 4 and 5.

FIGS. 10A and 10B illustrate an exemplary physical orientation of the contacts 135*a*, 135*b*, the antenna 22, and circuit board 150 in an extended and retracted position, respectively, according to the embodiment shown schematically in FIGS. 2 and 2A. As shown, the antenna second end portion 76 is smaller in cross-section than the upper antenna body. Correspondingly, one of the contacts 135*b* (shown here as the right-most contact) has a protrusion 136*b* which extends towards the central axis 50 a further distance than the other contact 135*a*. Thus, when the antenna 22 is extended, this configuration enables a selected one of the contacts (shown here as contact 135*b*) to electrically connect with the second end portion 76.

Figure 10C:
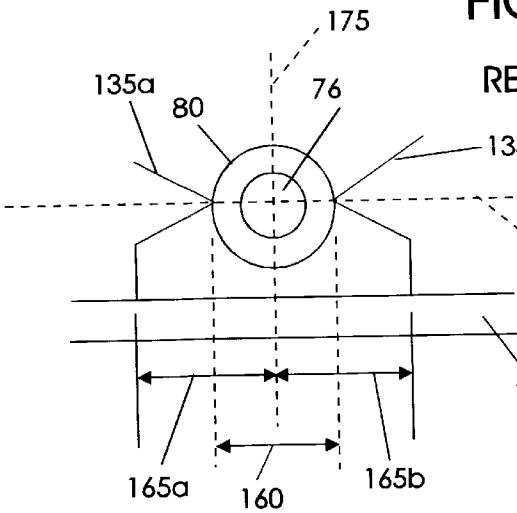

The antenna conducting contact portion 80 is positioned on the exterior surface of the antenna 22 so that when retracted, as illustrated in FIG. 10C, it is electrically connected with both circuit contacts 135*a*, 135*b* to short circuit certain of the components in the matching circuit 25 and provide a 50 Ohm input at the terminal feed 25*c* to the radiotelephone signal processing circuit. Of course the antenna first and second conducting portions 76, 80 can be configured in the reverse to engage the respective matching circuit 25 components. For example, by including a larger second portion and a smaller first portion and configuring the circuitry to correspond with the reverse antenna configurations. Likewise, the first and second circuit contacts 135*a*, 135*b* can be alternatively configured to engage the respective matching circuitry.

Preferably, the contacts 135*a*, 135*b* are disposed on the printed circuit board 150 (FIGS. 10A, 10B) such that they are transversely spaced-apart, each on different sides of the central axis 50. As used herein, if a rectangular antenna body is employed, the antenna then inherently has four sides and the term "different sides" is self-explanatory; whereas, if a cylindrical antenna is employed the term "different sides" is meant to include that the contacts are transversely spaced-apart a predetermined distance to assure selective activation of the contact without signal interference or electrical mismatch. For example, the contacts are on different sides of the central axis when they are circumferentially separated $\pi/4$ radians.

More preferably, the first and second contacts 135*a*, 135*b* are co-planarly aligned, i.e., each are configured and positioned such that together they define a mutual plane of contact 162 with the antenna 22. Also preferably, the first and second contacts 135*a*, 135*b* each include protrusions 136*a*, 136*b* which transversely extend a predetermined distance 165*a*, 165*b* towards the central axis 50. Further preferably, as shown, one protrusion 136*b* extends a further distance 165*b* towards the central axis 50 than the other 136*a*. Stated differently, the contacts 135*a*, 135*b* are preferably positioned on the circuit board 150 an equal distance away from a plane bisecting the central axis 175, but one contact 135*b* includes a protrusion which transversely extends a further distance towards the bisecting plane 175. As such, the contacts 135*a*, 135*b* are preferably symmetrically configured with respect to the central axis 50.

The contacts 135*a*, 135*b* are preferably mechanically and electrically affixed to contact traces on the printed circuit board 150 upstream of the 50 Ohm feed 25*c*. Also preferably, the contacts 135*a*, 135*b* are positioned one opposing the other such that the protrusions 136*a*, 136*b* extend toward the other to define a gap 160 width therebetween. As illustrated in FIGS. 10A and 10C, the gap 160 has a smaller width than the width of the antenna 22. The circuit contacts 135*a*, 135*b* can be spring loaded or formed out of a conductive resilient or flexible material so as to be transversely moveable about a plane of contact 162. An example of a suitable conducting flexible material is Beryllium Copper.

The antenna 22 is slidably extended and retracted between the upwardly extending contacts 135*a*, 135*b* such that the outer surface of the antenna upper body forces the protrusions 136*a*, 136*b* to move in a transverse direction away from the central axis 50 by following the shape of the antenna body, e.g., acting as a simplified cam-follower mechanism. As such, the circuit contacts 135*a*, 135*b* and the antenna body 22 are sized and positioned such that the contacts 135*a*, 135*b* include portions which snugly rest against the outer surface of the conductive portion of the antenna 22 in the retracted position. As discussed above, the conducting portion 80 on the upper body then physically contacts and electrically engages with both circuit contacts 135*a*, 135*b*.

As used herein the term "matching" system, circuit, or network includes circuit components which provide signal conditioning at the junction of the antenna 22 and printed circuit board terminals or antenna contacts 135*a*, 135*b* to provide a 50 Ohm circuit impedance at the feed terminal of the radiotelephone 25*c*. As shown, the matching network includes an L-C circuit, i.e., an inductor 25*b* and a capacitor 25*a* which are activated in the matching circuit 25 when the antenna 22 is extended. In contrast, the signal bypasses the higher impedance circuitry when the antenna 22 is extended as is exemplary shown in FIG. 3.

As will be appreciated by those of skill in the art, the above described aspects of the present invention may be provided by hardware, software, or a combination of the above. Thus while the various components have been described as discrete elements, they may in practice be implemented by a microcontroller including input and output ports running software code, by custom or hybrid chips, by discrete components or by a combination of the above. For example, the matching circuit 25, can be a implemented as a programmable controller device or as two separate circuits. Of course, discrete circuit components and discrete matching circuits corresponding to the impedance requirements of the antenna can be employed and can be mounted separately or integrated into a printed circuit board. Similarly, the term "printed circuit board" is meant to include any microelectronics packaging substrate.

Figure 4:
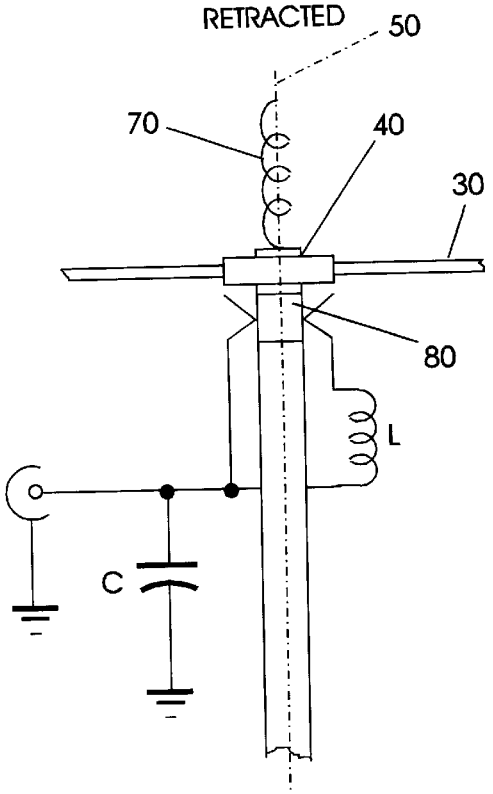
FIG. 4 is a schematic representation of an alternative embodiment of a matching switching system according to the present invention showing the antenna in the retracted position.
Figure 5:
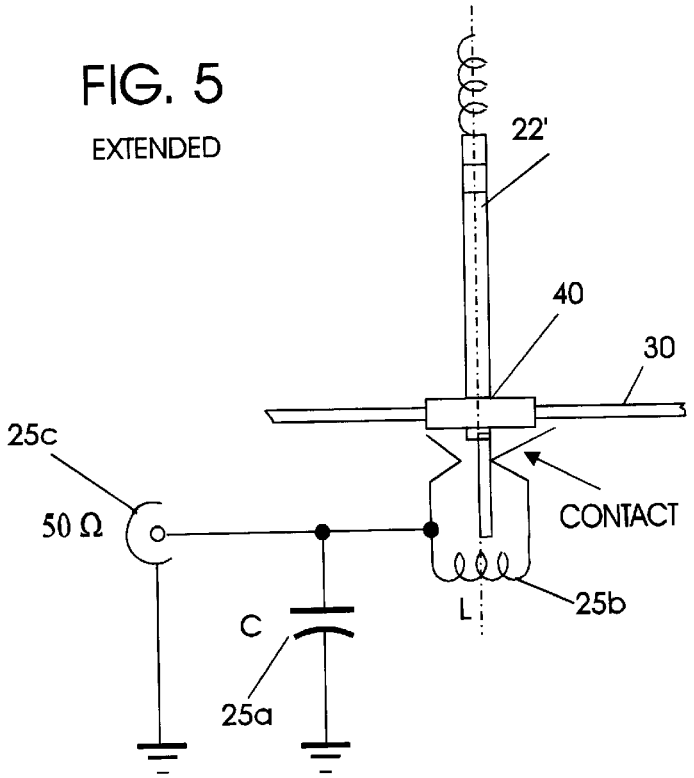
FIG. 5 is a schematic representation of the embodiment shown in FIG. 4 illustrating the antenna in an extended position.

FIGS. 4, 5 illustrate the particulars of an additional embodiment of the present invention corresponding to that shown in FIGS. 11A and 11B.

FIG. 4 shows the antenna 22' in the retracted position while FIG. 5 illustrates the antenna 22' extended. The antenna 22' is similar to that described above, but instead of a concentrically aligned second portion 76 (FIG. 2), this embodiment employs a conducting offset portion 200. The offset portion is electrically connected with the antenna element 70. The offset portion 200 is offset a predetermined distance from the center of the upper body of the antenna 22' so as to electrically and mechanically contact only one of the first and second contacts 35*a*, 35*b* when the antenna is extended.

Alternatively, the offset portion 200 can be combined with a laterally opposing non-conducting portion. For example, the antenna second end 45 has the same diameter as the upper body such that both contacts can be physically contacted by the second end 45 in the extended position. However, only the conducting (offset) portion 200 electrically engages with a selected contact to activate the corresponding matching circuitry 25 (not shown).

In any event, the switching is accomplished by engaging the conducting offset portion 200 with a selected one of the contacts (shown here as 35*b*) when the antenna 22' is extended. The antenna 22' also includes a first conducting portion 80 which, as described above, engages the corresponding matching circuit 25 by electrically contacting the first and second contacts 35*a*, 35*b* in the retracted position.

Figure 10D:
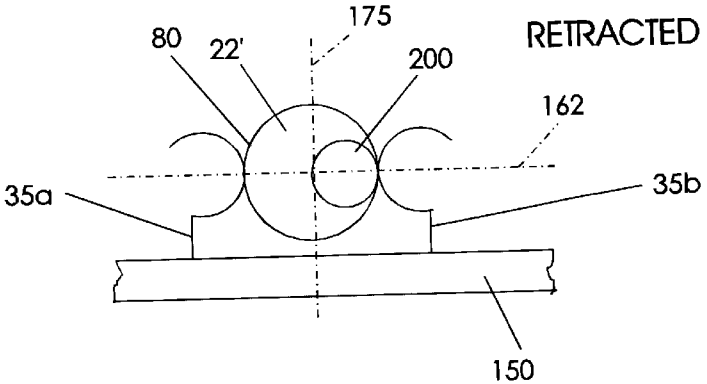

As shown in FIG. 10B and 11A, the first and second circuit contact portions 35*a*, 35*b* are positioned transversely spaced-apart on the printed circuit board 150. Preferably, the contacts 35*a*, 35*b* are disposed to be on different sides of the antenna 22' central axis 50. More preferably, the contacts 35*a*, 35*b* are symmetrically configured, i.e., are mirror images with respect to a plane which bisects the central axis 175. As shown in FIGS. 10B and 10D, the contacts 35*a*, 36*a* include protrusions 36*a*, 36*b* as described above. Exemplary protrusions 36*a*, 36*b* are shown and alternatively configured (rounded) to those shown in FIGS. 10A and 10C. It will be appreciated to those of skill in the art that any number of circuit contact configurations will also function according to the present invention and, thus, the contact configurations are not limited thereto.

Also preferred, as illustrated in FIG. 10B, the contacts 35*a*, 35*b* positioned on opposing sides of the antenna 22' and are configured such that the first contact 35*a*, the second contact 35*b*, and the first conducting portion 80 define a mutual plane of contact such that they are coplanarly aligned when the antenna 22' is in the extended position. Similarly, it is also preferred that the offset portion 200 be positioned and configured such that the plane of contact for the second contact 35*b* and the offset portion 200 is the same in the extended position.

Figure 6A:
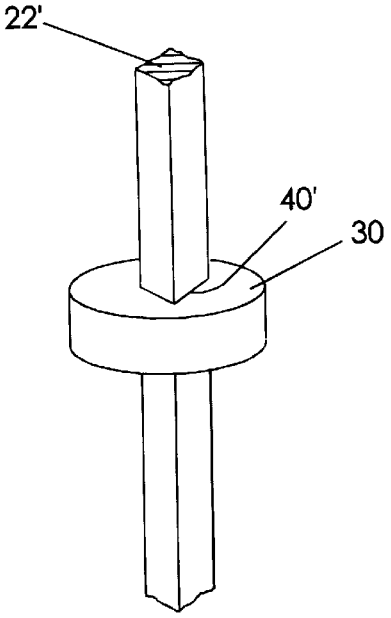
FIG. 6A is a partial perspective view of a first embodiment of an antenna rod of the present invention.
Figure 6B:
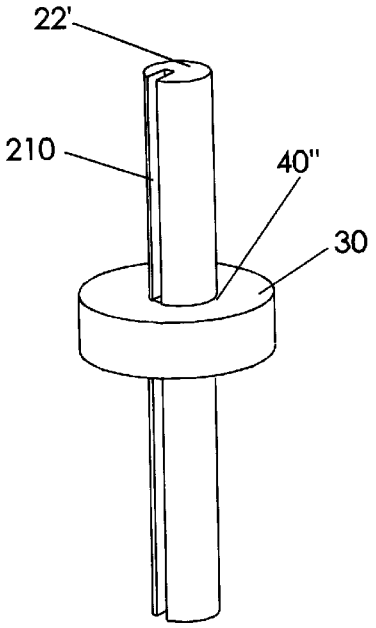
FIG. 6B is a partial perspective view of a second embodiment of an antenna rod of the present invention.

Further preferably, the antenna 22' is configured so as to prevent rotation about the central axis 50 as the antenna is extended and retracted so as to maintain the offset portion 200 in alignment with the selected contact 35*b*. Examples of suitable antenna configurations are shown in FIGS. 6A and 6B. FIG. 6A illustrates a rectangular antenna body 22' and corresponding housing opening 40' which maintains the orientation of the antenna 22' as it slides in and out of the opening 40'. FIG. 6B illustrates a keyed or tongue and groove antenna body 210 and corresponding housing opening 40".

Figure 7:
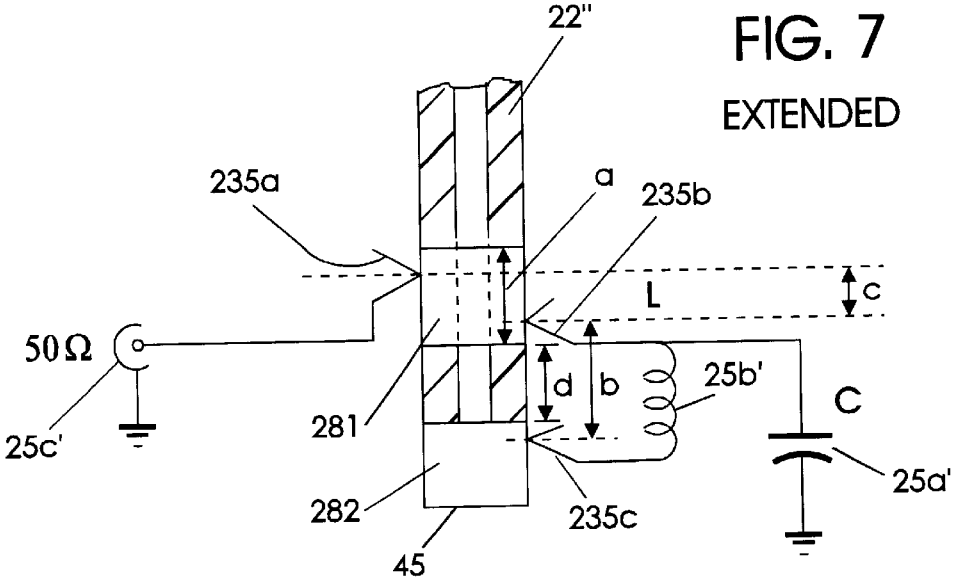
FIG. 7 is a schematic representation of an additional embodiment of a matching switching system, with the antenna in an extended position, according to the present invention

Yet another embodiment of the present invention is illustrated in FIGS. 7 and 8. FIG. 7 shows the antenna 22" in the extended position and FIG. 8 shows the antenna 22" retracted. In this embodiment, the switching configuration employs three conducting circuit contacts 235*a*, 235*b*, and 235*c*. Correspondingly, the antenna 22" is formed of a plurality of conductive portions 280, 281, 282 and a non-conducting substrate material 241 intermediate of the conducting portions. Advantageously, this embodiment enables the antenna 22" to disconnect or "switch out" reactive components of the matching circuit 25 in the retracted position thereby enabling a broader radiotelephone operational bandwidth.

More particularly described, the first and second antenna circuit contacts 235*a*, 235*b* are transversely spaced-apart such that each is preferably positioned on different sides of the central axis 50. More preferably, the transversely spaced-apart contacts 235*a*, 235*b* are positioned on opposing sides of the central axis 50. It is also preferred that the first and second transversely spaced-apart contacts are longitudinally offset a predetermined distance. The third contact 235*c* is electrically connected with and longitudinally spaced-apart from one of the first and second contacts 235*a*, 235*b* (shown here as the second contact 235*b*).

The antenna 22" is configured with a plurality of longitudinally spaced-apart conducting portions for selectively engaging with one or more of matching circuit contacts 235*a*, 235*b*, 235*c*. In particular, as shown in FIGS. 7 and 8, the antenna 22" includes a first conducting portion 280, a second conducting portion 281, and a third conducting portion 282. The first conducting portion 280 is positioned on the antenna 22' adjacent the antenna element 70 and is formed of a predetermined first longitudinal length. The second conducting portion 281 is an electrically floating contact ring and is longitudinally spaced-apart from said first conducting portion 280 along the length of the antenna. As such, the second conducting portion is not electrically connected to send antenna element 70. The third conducting portion 282 is positioned longitudinally spaced-apart a predetermined distance from the second conducting portion 281 and is electrically connected to the first conducting portion 280.

As shown in FIG. 7, the second and third contacts 235*b*, 235*c* when electrically concurrently engaged in the extended position activate the associated matching circuitry 25*a'*, 25*b'*, 25*c'*. As such, this embodiment is configured to electrically engage the first contact 235*a*, the second contact

235*b*, and the third contact 235*c* with corresponding conducting portions of the antenna 22" when in the extended position.

In contrast, as shown in FIG. 8, when the antenna 22" is retracted, the second and third contacts 235*b*, 235*c* are positioned against a non-conducting substrate 241 portion of the antenna and electrically disconnected from the matching circuit 25, which in turn disconnects reactive components 25*b*', 25*a* ' in the matching circuit. The first contact 235*a* engages with the first conducting portion 280 of the antenna 22" to separately activate the corresponding matching circuitry 25*c*.

In order to facilitate the switching as described above, referring to FIG. 7, the first and second contacts 235*a*, 235*b* define a longitudinal offset (c) which is preferably less than the length (a) of the second conducting portion 281. Similarly, it is preferred that the distance (d) between the second and third conducting portions 281, 282 is less than the longitudinal spaced-apart distance (b) of the second and third contacts 235*b*, 235*c*. Thus configured, when the antenna 22" is extended, the signal is transmitted down the antenna rod to the third circuit contact 235*c*, processed through the matching components 25*a*', 25*b*', and connected back to the antenna rod 22" via the second contact 235*b* to the floating contact 281, the first contact 235*a* and ultimately the 50 Ohm signal feed terminal 25*c*'.

It is also preferred that the first conducting portion 280 have a length (e) which is less than the longitudinal offset (c) of the first and second contacts 235*a*, 235*b*, and the length (a) of the floating contact ring 282. The antenna 22" and housing opening 40 can be keyed to assist in alignment of the antenna 22" to the contacts 235*a*, 235*b*, 235*c*, as described above (FIGS. 6, 6A).

Figure 11C:
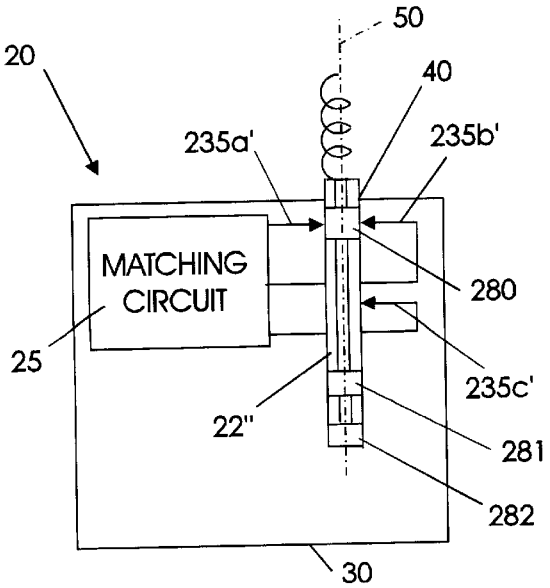
FIGS. 11C and 11D are schematic representations of a radiotelephone with the matching switching system illustrated in FIGS. 7 and 9.
Figure 11D:
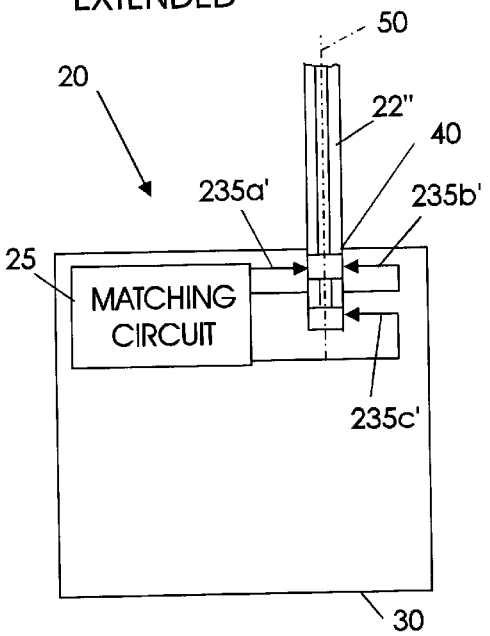

An alternative embodiment of the switching system illustrated in FIGS. 7 and 8, is shown in FIG. 9 (FIGS. 11C, 11D). In this embodiment, the first and second contacts 235*a*40 , 235*b* ' can be aligned without a longitudinal offset. For example, the contacts 235*a*', 235*b* ' can be transversely spaced-apart on opposing sides of the central axis and substantially co-planarly aligned about the plane of contact. This configuration will electrically connect the 50 Ohm feed 25*c* ' via the first contact 235*a* ' when the antenna 22' is in the retracted position, but will not disconnect the second contact 235*b*'. The third contact 235*c* ' resides against a non-conductive substrate and leaves that portion of the matching circuit 25*a*40 , 25*b* ' open.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clause are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A radiotelephone, comprising:

a retractable antenna having opposing first and second ends with respective first and second externally accessible conductive portions and defining a central axis through the center thereof, said antenna slidably extendable about said central axis between a first extended position and a second retracted position, wherein said antenna has a first impedance in said first position and a second impedance less than the first impedance in said second position;

a radiotelephone housing configured to receive said retractable antenna therein;

a radiotelephone printed circuit board disposed in said housing adjacent said antenna, said printed circuit board including first and second transversely spaced-apart antenna circuit contacts; and a matching circuit operably associated with at least one of said antenna circuit contacts, wherein when said antenna is extended said matching circuit is activated upon contact between said antenna and one or the other single one of said first and second transversely spaced-apart antenna circuit contacts thereby matching the increased impedance attributed thereto.

2. A radiotelephone according to claim 1, wherein said antenna comprises a first width along a portion of said first end and a second width smaller than said first width along a portion of said second end wherein each of said first and second transversely spaced-apart antenna circuit contacts are positioned on different sides of said central axis, and wherein said matching circuit is activated by contact between a portion of said antenna second width and a selected one of said first and second transversely spaced-apart antenna circuit contacts.

3. A radiotelephone according to claim 1, wherein said first and second transversely spaced-apart antenna circuit contacts define an electrical path with an inductor therebetween and are positioned on said printed circuit board such that each is substantially aligned with the other along the region of contact with said antenna and wherein said inductor is short-circuited when said antenna is in said retracted position.

4. A radiotelephone, comprising:

a retractable antenna having opposing first and second ends and defining a central axis through the center thereof, said antenna slidably extendable about said central axis between a first extended position and a second retracted position, wherein said antenna has a first impedance in said first position and a second impedance less than the first impedance in said second position;

a radiotelephone housing configured to receive said retractable antenna therein;

a radiotelephone printed circuit board disposed in said housing adjacent said antenna, said printed circuit board including first and second transversely spaced-apart antenna circuit contacts; and a matching circuit operably associated with at least one of said first and second antenna circuit contacts. wherein when said antenna is extended said matching circuit is activated to match the increased impedance attributed thereto;

wherein each of said first and second transversely spaced-apart antenna circuit contacts are positioned on different sides of said central axis, and wherein said matching circuit is activated by contact with a selected one of said first and second transversely spaced-apart antenna circuit contacts;

wherein said first and second transversely spaced-apart antenna circuit contacts are positioned on said printed circuit board such that each is substantially co-planar with the other along the plane of contact with said antenna; and wherein said first and second transversely spaced-apart antenna circuit contacts extend a predetermined distance toward the central axis, and wherein one of said first and second transversely spaced-apart antenna circuit contacts extends toward the central axis a greater distance than the other.

5. A radiotelephone according to claim 4, wherein said first and second transversely spaced-apart antenna circuit contacts each include protrusions thereon, and wherein said first and second transversely spaced-apart antenna circuit contacts are positioned on said printed circuit board such that each protrusion laterally extends toward the other defining a gap therebetween.

6. A radiotelephone according to claim 5, said antenna having a width, and wherein the width of said gap is less than the width of said antenna.

7. A radiotelephone according to claim 5, wherein said first and second laterally extending protrusions have a first gap width when said antenna is in the retracted position and a second gap width when said antenna is in the extended position, said first gap width being larger than said second gap width, said antenna including a circuit contact portion thereon, and wherein in the extended position, said first antenna circuit contact, said antenna circuit contact portion, and said second antenna circuit contact are serially aligned.

8. A radiotelephone, comprising:

a retractable antenna having opposing first and second ends and defining a central axis through the center thereof, said antenna including an offset conducting circuit contact portion on said second end, said antenna slidably extendable about said central axis between a first extended position and a second retracted position, wherein said antenna has a first impedance in said first position and a second impedance less than said first impedance in said second position;

a radiotelephone housing configured to receive said retractable antenna therein, wherein said antenna first end is extendable out of said housing and said second end is non-extendable out of said housing;

a radiotelephone printed circuit board disposed in said housing adjacent said antenna, said printed circuit board including first and second transversely spaced-apart antenna circuit contacts, each positioned on different sides of said central axis;

a matching circuit including an inductor operably associated with each of said antenna circuit contacts, wherein when said antenna is extended said matching circuit is electrically activated by contact with said antenna offset portion to match the increased impedance attributed thereto; and wherein when said antenna is retracted said inductor is short-circuited from said matching circuit.

9. A radiotelephone according to claim 8, wherein said offset portion is offset from said central axis, and wherein said first and second transversely spaced-apart antenna circuit contacts are symmetrically disposed about said central axis.

10. A radiotelephone according to claim 9, wherein said first and second transversely spaced-apart antenna circuit contacts are mirror images of the other.

11. A radiotelephone according to claim 8, wherein when said antenna is in an extended position, a selected one of said first and second transversely spaced-apart antenna circuit contacts engages with said antenna circuit offset portion to electrically connect said matching circuit.

12. A radiotelephone according to claim 11, wherein said antenna is configured to resist rotation about said central axis.

13. A radiotelephone according to claim 8, wherein said first and second transversely spaced-apart antenna circuit contacts are positioned on said printed circuit board such that each is substantially aligned with the other along the region of contact with said antenna.

14. A radiotelephone according to claim 8, wherein said first and second transversely spaced-apart antenna circuit contacts extend a predetermined distance toward the central axis, and wherein said matching circuit includes an inductor positioned in an electrical path defined between said first arid second transversely spaced-apart antenna circuit contacts such that said inductor is short-circuited when said antenna is in said retracted position.

15. A radiotelephone according to claim 14, wherein said first and second transversely spaced-apart antenna circuit contacts each include protrusions thereon, and wherein said first and second transversely spaced-apart antenna circuit contacts are positioned on said printed circuit board such that each protrusion extends toward the other, defining a gap therebetween.

16. A radiotelephone according to claim 15, said antenna having a width, and wherein the width of said gap is less than the width of said antenna.

17. A radiotelephone according to claim 8, said antenna including a first conducting contact portion thereon, wherein in the retracted position, said circuit board first antenna circuit contact, said antenna first conducting contact portion, and said circuit board second antenna circuit contact are serially aligned.

18. a radiotelephone, comprising:

a retractable antenna having opposing first and second ends and defining a central axis through the center thereof, said antenna comprising an antenna element, and first, second, and third conductive contact portions, wherein said second conductive contact portion electrically floats relative to said antenna element and said first and third conductive portions, said antenna slidably extendable about said central axis between a first extended position and a second retracted position, wherein said antenna has a first impedance in said first position and a second impedance less than said first impedance in said second position;

a radiotelephone housing configured to receive said retractable antenna therein;

a radiotelephone printed circuit board disposed in said housing adjacent said antenna, said printed circuit board including first, second, and third antenna circuit contacts, wherein said first and second contacts are transversely spaced-apart, and said third contact is electrically connected with and positioned longitudinally spaced-apart from said second contact; and a matching circuit operably associated with each of said antenna circuit contacts, wherein when said antenna is extended said matching circuit is activated to match the increased impedance attributed thereto.

19. A radiotelephone according to claim 18, wherein when said antenna is in the retracted position said antenna is configured to disconnect reactive components of said matching circuit thereby enabling a broader radiotelephone operational bandwidth, and wherein said first antenna circuit contact is arranged relative to said second antenna circuit contact such that it is positioned longitudinally above or substantially linearly across from said second antenna circuit contact.

20. A radiotelephone according to claim 18, said antenna having opposing first and second ends and an outer surface defined therebetween, wherein said antenna outer surface is formed of a non-conducting substrate material intermediate of said conducting portions, and wherein said first end is extendable out of said housing and said second end is retained in said housing, and wherein when said antenna is in said extended position, said first and second transversely spaced-apart antenna circuit contacts contact said antenna second conducting portion while said third antenna circuit contact contacts said antenna third conducting portion.

21. A radiotelephone according to claim 20, wherein said first and second transversely spaced-apart antenna circuit contacts are positioned on different sides of said central axis.

22. A radiotelephone according to claim 20, said first antenna circuit contact residing on a first side of said central axis, said second and third antenna circuit contacts residing on the opposing side of said central axis, wherein said second and third antenna circuit contacts define an electrical path comprising an inductor therebetween, and wherein the longitudinal distance between said second and third antenna circuit contacts on said printed circuit board is substantially equivalent to said predetermined distance between said second and third antenna conducting portions.

23. A radiotelephone according to claim 22, wherein said first and second transversely spaced-apart antenna circuit contacts are positioned on said printed circuit board such that each is substantially aligned with the other across the width of said antenna.

24. A radiotelephone according to claim 20, wherein said first antenna circuit contact is arranged relative to said second antenna circuit contact such that it is positioned longitudinally thereabove to define a longitudinal offset distance, said antenna first conducting portion having a first length, and wherein said first and second contact longitudinal offset distance is greater than said first length of said first conducting portion.

25. A radiotelephone according to claim 24, wherein said longitudinal offset between said first and second antenna circuit contacts is less than said longitudinal distance between said second and third antenna conducting portions, wherein said matching circuit and associated inductor is included in the signal path when said antenna is in said extended position via engagement between said antenna second conducting portion with said first and second antenna circuit contacts and said antenna third conducting portion with said third antenna circuit contact, and wherein said matching circuit inductor is disconnected from the signal path when said antenna is in said retracted position via engagement between said antenna first conducting portion with at least one of said first and second antenna circuit contacts engagement of said third antenna circuit contact with said non-conducting antenna material.

26. A radiotelephone according to claim 18, wherein said first and second contacts each include protrusions thereon, and wherein said contacts are positioned on said printed circuit board such that each protrusion extends toward the other, defining a gap therebetween.

27. A radiotelephone according to claim 26, said antenna having a width, and wherein the width of said gap is less than the width of said antenna.

28. A radiotelephone, comprising:

a retractable antenna having opposing first and second ends and defining a central axis through the center thereof, said antenna slidably extendable about said central axis between a first extended position and a second retracted position, wherein said antenna has a first impedance in said first position and a second impedance less than the first impedance in said second position;

a radiotelephone housing configured to receive said retractable antenna therein;

a radiotelephone printed circuit board disposed in said housing adjacent said antenna, said printed circuit board including first and second transversely spaced-apart antenna circuit contacts; and a matching circuit operably associated with at least one of said antenna circuit contacts, wherein when said antenna is extended said matching circuit is activated to match the increased impedance attributed thereto;

wherein each of said first and second transversely spaced-apart antenna circuit contacts are positioned on circumferentially spaced apart relative to the central axis, and wherein said matching circuit is activated by contact with at least one of said first and second transversely spaced-apart antenna circuit contacts, and wherein said first and second transversely spaced-apart antenna circuit contacts are configured with laterally extending arms oriented to face toward the central axis, and wherein one of said first and second laterally extending arms is closer to the central axis than the other.

29. A radiotelephone according to claim 28, wherein said first and second transversely spaced-apart antenna circuit contact laterally extending arms are substantially collinear aligned arms, and wherein when said antenna is in the first extended position said antenna is configured to contact a selected one of said transversely opposing antenna circuit contact arms.

30. A radiotelephone according to claim 28, wherein when said antenna is in the second retracted position, said antenna is configured to contact both of said transversely opposing antenna circuit contact arms.

* * * * *

UNITED STATES PATENT AND TRADEMARK OFFICE

CERTIFICATE OF CORRECTION

PATENT NO. : 5,969,683

DATED : October 19, 1999

INVENTOR(S) : Gerald J. Hayes

It is certified that error appears in the above-identified patent and that said Letters Patent is hereby corrected as shown below:

Column 12, Claim 14, Line 19 correct "arid" to read – and --.

Column 14, Claim 30, Line 50 correct "claim 28" to read – claim 29 --.